US005526664A

United States Patent [19]

Vetter

[11] Patent Number: 5,526,664

[45] Date of Patent: Jun. 18, 1996

[54] METHOD OF FORMING A TEXTURED PATTERN ON A METAL PLATE WHICH PATTERN IS TRANSFORMED TO A PLASTIC PART, AND A PRESS PLATE AND PLASTIC PART PRODUCED THEREBY

[75] Inventor: Kirk R. Vetter, Caledonia, Mich.

[73] Assignee: Progressive Technologies, Inc., Grand Rapids, Mich.

[21] Appl. No.: 301,690

[22] Filed: Sep. 7, 1994

[51] Int. Cl.[6] ..... C21D 9/06

[52] U.S. Cl. ..... 72/53

[58] Field of Search ..... 72/53; 29/90.7

[56] References Cited

U.S. PATENT DOCUMENTS

| | | | |
|---|---|---|---|
| 4,419,875 | 12/1983 | DeClark et al. . | |
| 4,423,613 | 1/1984 | DeClark et al. . | |
| 4,426,867 | 1/1984 | Neal et al. . | |
| 4,428,213 | 1/1984 | Neal et al. . | |
| 4,432,220 | 2/1984 | Loersch et al. . | |
| 4,454,740 | 6/1984 | Neal et al. | 72/53 |
| 4,470,292 | 9/1994 | DeClark et al. . | |
| 4,581,913 | 4/1986 | Reed | 72/53 |
| 5,193,375 | 3/1993 | Meister | 72/53 |
| 5,205,145 | 4/1993 | Ishino et al. | 72/53 |

*Primary Examiner*—David Jones

*Attorney, Agent, or Firm*—Price, Heneveld, Cooper, DeWitt & Litton

[57] ABSTRACT

A method and apparatus are provided for imparting a textured surface to a work piece, particularly a metal plate or platen used to impress a textured surface on a sheet of plastic laminate or the like. According to one form of the invention, a stream of balls having substantially uniform size, shape, and weight are propelled against a surface of the work piece at a velocity sufficient for the balls to create an impact impression on the surface of the work piece. Particular characteristics of the texture may be varied by changing the velocity, size, shape, weight, size of the stream, distance travelled by the steel balls, and the sweep rate over the work surface. A suction blast gun having a particular size air jet and nozzle projects the balls against the work piece which are fed to the gun through a magazine. The balls are propelled against the surface by a pressurized fluid.

22 Claims, 1 Drawing Sheet

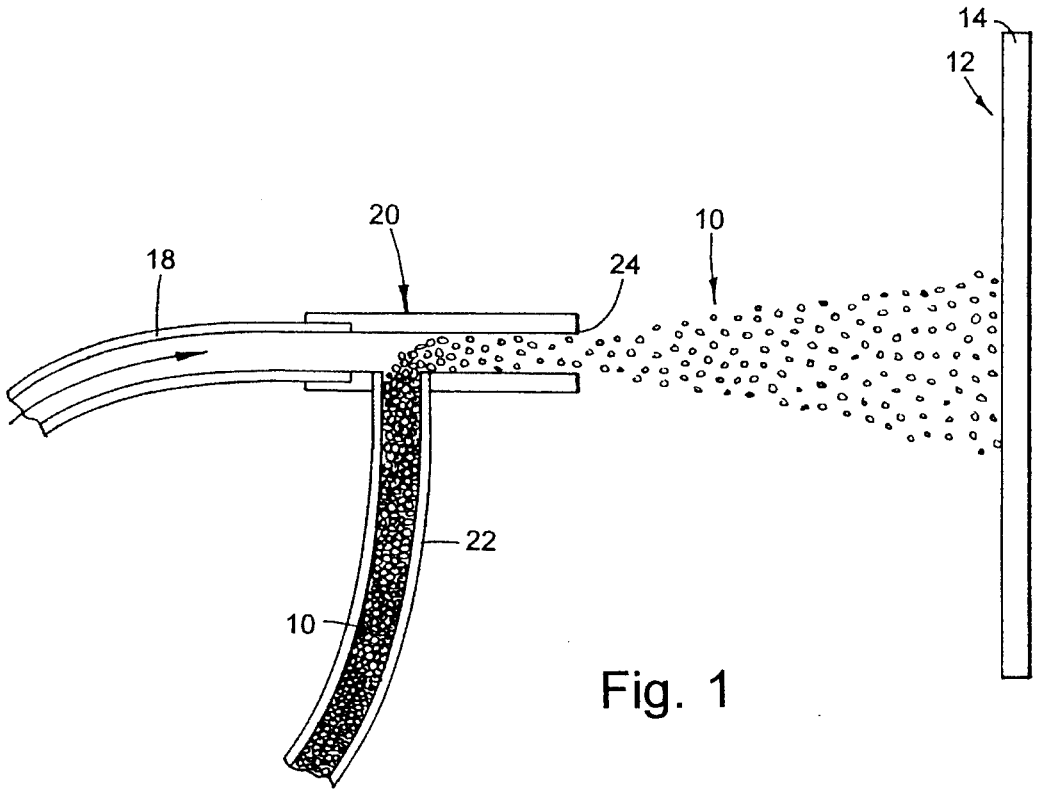
Fig. 1
Fig. 2
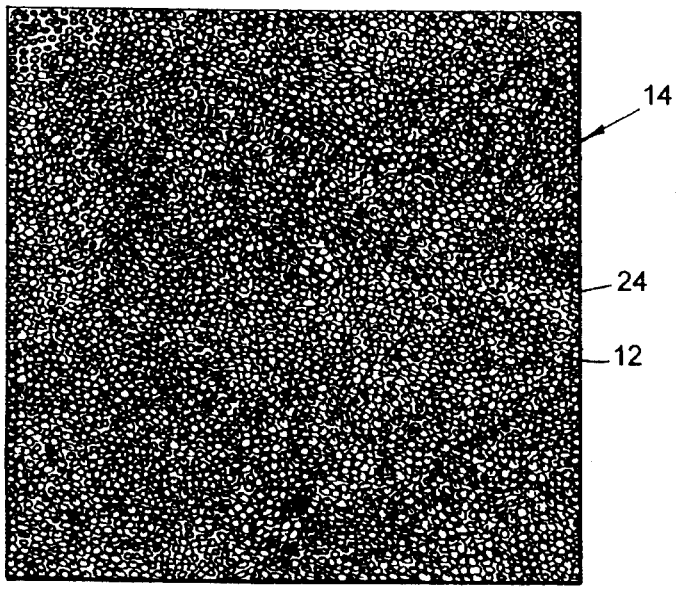

METHOD OF FORMING A TEXTURED PATTERN ON A METAL PLATE WHICH PATTERN IS TRANSFORMED TO A PLASTIC PART, AND A PRESS PLATE AND PLASTIC PART PRODUCED THEREBY

FIELD OF THE INVENTION

This invention relates generally to a unique method for forming a textured pattern of generally uniform character on the surface of a plate and particularly on a press plate, which, in turn, is used to impress a similar textured surface on a plastic laminate. This invention also pertains to such press plate produced by such method.

DISCUSSION OF THE RELATED ART

Plastic laminates, such as Formica® brand plastic laminate, have been used in ever-increasing applications ever since their introduction in the middle part of the century. Plastic laminates come in a variety of finishes, including glossy, semi gloss, satin, or fiat finishes. Textures also vary, ranging from very smooth texture (having no relief) to a matte-like finish with relief ranging from 0.01 to 0.1 millimeters (mm). When done properly, plastic laminates can give the appearances of metals to leather or paper.

In the case of laminates having a textured surface, such textures are formed on the resin sheet while curing by pressing a plate with a similar textured surface against the resin. The plate, in essence, imposes a negative impression of its surface on the plastic laminate.

Traditionally, such press plates or platens are made from a zirconium, titanium, or chromium plated metal which has been chemically etched to create the textured "negative" surface. However, because of the ever-increasing chemical pollutants entering the environment, and of the desire to remove such materials from the environment, there is a need to provide an alternate way of creating the "negative" textured surface on plates used to impart a pattern on a work piece, such as a sheet of plastic laminate.

It has been suggested that the textured surface be formed by projecting a randomly shaped media with a blast gun against the surface of the press plate so as to form impressions on the plate. Such random media does not produce a suitable press plate. Projecting specific steel balls of essentially the same diameter against the surface of the press plate produced a uniform impression on the surface of the press plate. Therefore, when impressed on the plastic laminate, the finished press plate produced a uniform texture on the surface of the laminate.

SUMMARY OF THE INVENTION

The instant invention does away with the chemical treatment of metals to produce textured surfaces, particularly on press plates used in the plastic laminate industry. The media used in the invention are recyclable and, if introduced to the environment, have a far less impact than caustic acids and etching chemicals.

According to one form of the invention, a method is provided for texturing a surface of a plate including propelling a stream of steel balls having generally identical size, weight, and shape against a surface of the plate. Each ball impacts the plate's surface and creates an impression. The impressions substantially coalesce in a generally uniform fashion to produce the textured surface. It is preferred that the steel balls propelled against the work piece have a surface harness within the range of Rockwell C50 and C52, a core hardness within the range of Rockwell C42 and C52, and a case depth averaging 0.6 mm.

More specifically, this invention provides a method for producing a uniform pattern on a steel press plate used to impress the pattern of a work piece, including the step of projecting a stream of balls of substantially identical size, weight, and shape at a right angle to a surface of the press plate, wherein the stream of balls impacts the surface of the plate such that each ball creates an impression having a uniform pattern. The balls are projected at the surface by placing the balls in fluid communication with a pressurized stream of gas passing through a nozzle. The balls are entrained in the stream and ejected from the nozzle at a velocity ranging between 1.0 and 10.0 meters per second. The pattern is formed on the work piece by a coalescing of the impressions formed by the impacting balls.

According to another form of the invention, a press plate or platen is provided for imparting a pattern on a surface of a plastic laminate. The platen includes a metallic plate of geometric shape with at least one surface adapted and configured to be pressed against the laminate. The surface includes a uniform pattern formed thereon by propelling a plurality of balls of substantially identical size, shape, and weight at a generally right angle thereto. The impacting balls create impressions to form the uniform textured surface.

BRIEF DESCRIPTION OF THE DRAWINGS FIGURES

A better understanding of the invention and the advantages provided thereby may be obtained by reference to the specification and the attached drawing figures, wherein:

FIG. 1 is a schematic representation of the method provided by the invention; and FIG. 2 is a plan view of one surface of a press plate uniformly textured according to the method of this invention.

DETAILED DESCRIPTION OF THE INVENTION

FIG. 1 schematically illustrates the method and apparatus used to texture one surface of a metal plate. Although the following description will be made with respect to a particular metal plate, i.e., a press plate for impressing a texture on a plastic laminate, it is contemplated that the method could be used in a number of different applications.

Referring to FIG. 1, a stream of balls 10 are projected against a surface 12 of a work piece, such as a metal plate 14, by compressed air 16 fed through a hose 18 to a suitable nozzle or gun 20. It is preferred that the balls are projected at a right angle to surface 12 at a velocity sufficient that each ball will create an impression in surface 12 from the impact. The size of the impression created by each ball will depend upon the shape, diameter, and weight of the balls used as well as the type of material constituting each ball. It is preferred that the balls have a substantially uniform diameter, size, and weight so that all of the balls in the stream 10 will have generally the same velocity upon impacting surface 12 of work piece 14. More specifically, it is preferred that the balls be made from a Class A material which meets the requirements of A.M.S. 5032 with a chemical composition meeting the requirements of S.A.E. #1013, S.A.E. #1015 through S.A.E. #1022, and S.A.E. J403. Most preferably, the balls are made from a carburized, hardened, and tempered steel with a surface hardness within the range of Rockwell C50 and Rockwell C55. The core hardness of the steel balls is preferably within the range of Rockwell C42 and Rockwell C52. Optimally, the balls shall not be through hardened with no one ball having a case hardness less than Rockwell C50 or a core hardness less than Rockwell C42. It is also preferred that the average case depth shall be within the range of 0.58 mm and 0.65 mm preferably 0.60 mm, and most preferably 0.635 mm. The size variation in the steel balls shall meet the requirements of A.F.B.M.A. Carbon Steel Grade 1,000 balls. More specifically, the sphericity diameter total tolerance per ball may run on the order of 0.025 mm with the basic diameter tolerance per lot within the range of ±0.05 mm. It is further preferred that the surface condition of these Class A materials be polished and free of cracks, pits, lapse, or surface flaws visible when magnified 20× normal.

In one embodiment, the Class A steel balls are fed through a magazine or hose 22 to the blast nozzle or gun 20. One example of a suitable blast gun is a Suction Blast Gun, Model No. 700132 having a 3/16" air jet and a 3/8" nozzle, available from Progressive Technologies of Grand Rapids, Mich. The steel balls fed to gun 20 become entrained in a compressed column of air 16 within the gun 20 and ejected from the nozzle tip 24 under an air pressure within the range of 50 psi and 100 psi, preferably within the range of 70 psi and 90 psi, and most preferably at 80 psi. Under these conditions, the nozzle is slowly swept or moved with respect to surface 12 at a distance within the range of 15 centimeters (cm) and 100 cm, preferably within the range of 30 cm and 70 cm, and most preferably 60 cm. Within this range, the impact of the stream of steel balls upon surface 12 creates coalescing impact craters or impressions to produce a textured surface upon the work piece. The pattern density and the area of surface 12 to be treated may be controlled either manually by an operator holding blast gun 20 or mechanically under the use of a robotic arm programmed to control the rate of movement of nozzle 24 as well as the exact pattern to be followed with respect to surface 12.

FIG. 2 generally illustrates one example of a work piece 14 such as a press plate used to create a textured surface on a sheet of plastic laminate. In the embodiment shown in FIG. 2, the entire surface 12 of press plate or platen 14 has been textured using the technique as described above. The coalescing impact craters created by the steel balls have provided or created a generally uniform rough texture. Depending upon the size and weight of the balls, and upon the velocity with which they are propelled against the surface, the relief of the textured surface is within the range of 0.02 mm and 2.0 mm, preferably within the range of 0.1 mm and 1.0 mm, and most preferably within the range of 0.4 mm and 0.8 mm.

For any particular region of the treated surface, it is apparent that the textured surface is created by impacts of the steel balls against surface 12. The pattern created by the steel balls produces a generally uniform textured surface by continually sweeping or moving the spraying or blasting of the steel balls with respect to surface 12. That is to say, that the stream of steel balls is never maintained in any one particular location for a length of time. However, it is contemplated that variations may be made on the textured surface by changing the angle of impact, the distance between blast nozzle tip 24 and work surface 12, the air pressure used to entrain the steel balls and project them against the surface, the size and weight of the media, as well as the type of media, and the rate at which surface 12 is covered.

For example, in one application, a press plate or platen for forming a textured surface on a sheet of plastic laminate is a surface textured using the above technique. The press plate included a metal plate of predetermined geometric shape and had at least one surface adapted and configured to be pressed against a yet uncured sheet of plastic laminate. A generally uniform pattern was formed on the one surface of the press plate by propelling a generally continuous stream of steel balls having a substantially identical shape, size, and weight, against the surface. The pattern performed by the projectiles resulted in a generally uniform rough texture with a relief within the range of 0.4 mm and 0.8 mm. The press plate was made from a zirconium and titanium alloy having a proximate Rockwell hardness of C40. The media used to texture the surface included Class A steel balls having a diameter within the range of 0.5 mm and 1.0 mm, carburized, hardened, and tempered to produce a surface hardness within the range of Rockwell C50 and C55, an average case depth of approximately 0.635 mm, and a core hardness within the range of Rockwell C40 and C55. The steel balls had polished surfaces which are free of cracks, pits, laps, and surface flaws when examined at 20× magnification.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

I claim:

1. A method for imparting a textured surface on a metal plate, comprising the step of:

providing a metal plate having a hardness of Rockwell C40 or less;

projecting a stream of spherical steel balls against a surface of the metal plate at an angle substantially perpendicular to said surface, said balls having a hardness greater than the surface of said plate and having a velocity sufficient to create impressions in said surface, such impressions having a relief ranging from 0.02 to 2.0 millimeters; and each steel ball having a substantially uniform diameter in the range of 0.5 and 1.0 millimeters, said steel balls imparting a generally uniform rough texture to said surface of the plate.

2. The method as defined in claim 1, wherein the step of projecting said stream of steel balls against the surface of the work piece includes feeding said steel balls into a stream of compressed air;

entraining said steel balls in said stream of compressed air; and blasting said stream of compressed air and entrained steel balls from a nozzle of a blasting gun used to control the projection of said steel balls against the surface of the plate.

3. The method as defined in claim 2, further including providing said steel balls with a surface hardness within the range of Rockwell C42 and C52.

4. The method as defined in claim 3, further including the step of providing said steel balls with a surface hardness with the range of Rockwell C50 and C55.

5. The method as defined in claim 2, further including the step of providing said steel balls with a hardened and tempered surface having an average case depth of 0.635 millimeters.

6. The method as defined in claim 2, further including providing said steel balls with a case hardness not less than Rockwell C45.

7. The method as defined by claim 2, further including providing said steel balls with a core hardness ranging between Rockwell C40 and C55.

8. The method as defined by claim 7, wherein said core hardness ranges between Rockwell C42 and C52.

9. The method as defined in claim 1, further including impacting said steel balls at a substantially right angle against said surface of the work piece to produce said generally rough texture along said surface, said rough texture having a relief ranging between 2.0 millimeters and 0.02 millimeters.

10. The method as defined by claim 9, wherein said generally rough texture is substantially uniform across a predetermined region of said surface of said work piece.

11. The method as defined in claim 1, further including providing said steel balls with a polished surface substantially free of cracks, flat spots or laps, pits, and surface flaws when examined at 20× magnification.

12. A method for producing a generally uniform textured pattern on at least one surface of a metal press plate used to impress said uniform pattern on a work piece, comprising the steps of:

providing a metal plate having a hardness of Rockwell C40 or less;

projecting a stream of substantially spherical balls at a generally right angle to the surface of the steel platen at a velocity sufficient to create an impression on said surface; and causing said stream of substantially spherical balls to impact at generally said right angle to the surface of the steel platen, such that each ball creates an impression on the surface of the steel platen to create the generally uniform pattern each of said impressions having a relief ranging from 0.02 to 2.0 millimeters; each of said balls formed from a material having a substantially uniform diameter ranging between 0.50 and 1.0 millimeters, a surface hardness ranging between Rockwell C40 and C65, a core hardness ranging between Rockwell C35 and C65, and a case hardness greater than Rockwell C45.

13. The method as defined in claim 12, wherein the step of projecting includes:

placing said balls in fluid communication with a pressurized stream of gas in a nozzle;

entraining said balls in said pressurized stream of gas within said nozzle; and ejecting said pressurized stream of gas and said balls entrained therein from said nozzle at a velocity ranging between 1.0 and 10.0 meters per second.

14. The method as defined in claim 12, wherein the step of causing said ball to impact the surface of the steel platen to create said impression includes forming a plurality of impact craters each having a relief ranging between 0.01 and 1.0 millimeters.

15. The method as defined in claim 14, further including the step of coalescing said plurality of impact craters to produce a generally uniform textured pattern.

16. The method as defined in claim 12, further including providing said balls with a polished surface substantially free of cracks, flat spots or laps, pits, and surface flaws when examined at 20× magnification.

17. A method for imparting a textured surface on a plastic part, comprising the step of:

providing a metal plate;

projecting a stream of spherical steel balls against a surface of said metal plate at an angle substantially perpendicular to said surface, said balls having a hardness greater than the surface of said plate and having a velocity sufficient to create an impression in said surface;

each steel ball having a substantially uniform diameter in the range of 0.5 and 1.0 millimeters, said steel balls imparting a generally uniform rough texture to said surface of the plate;

providing a plastic part; and transforming said texture to said plastic part by pressing said surface of said plate on said plastic part to provide a texture on the surface of said part, such texture corresponding to the texture on said surface of said plate.

18. The method as defined in claim 17, wherein the step of projecting said stream of steel balls against the surface of the work piece includes feeding said steel balls into a stream of compressed air;

entraining said steel balls in said stream of compressed air; and blasting said stream of compressed air and entrained steel balls from a nozzle of a blasting gun used to control the projection of said steel balls against the surface of the plate.

19. The method as defined in claim 17, further including providing said steel balls with a surface hardness within the range of Rockwell C42 and C52 and the hardness of said plate being Rockwell C40 or less.

20. The method as defined in claim 19, further including the step of providing said steel balls with a surface hardness with the range of Rockwell C50 and C55.

21. The method as defined in claim 17, further including impacting said steel balls at a substantially right angle against said surface of the work piece to produce said generally rough texture along said surface, said rough texture having a maximum relief ranging between 2.0 millimeters and 0.02 millimeters.

22. The method as defined by claim 21, wherein said generally rough texture is substantially uniform across a predetermined region of said surface of said work piece and plastic part.

* * * * *